US005169024A

United States Patent [19]

Rinkewich

[11] Patent Number: 5,169,024

[45] Date of Patent: Dec. 8, 1992

[54] MULTIPLE-WALL PLASTIC CONTAINER AND METHOD OF MAKING SAME

[76] Inventor: Isaac Rinkewich, 48-22 Garden View Ter., Hightstown, N.J.

[21] Appl. No.: 600,940

[22] Filed: Oct. 22, 1990

[51] Int. Cl.[5] ..... B65D 6/00

[52] U.S. Cl. ..... 220/586; 220/469; 220/673; 220/675

[58] Field of Search ..... 220/3, 444, 469, 671, 220/672, 673, 586, 675

[56] References Cited

U.S. PATENT DOCUMENTS

| | | | |
|---|---|---|---|
| 1,907,884 | 5/1933 | Sexton | 220/469 X |
| 3,120,570 | 2/1964 | Kennedy et al. | 220/444 X |
| 3,298,554 | 1/1967 | Piker | 220/444 X |
| 3,312,373 | 4/1967 | Gentry | 220/444 X |
| 4,257,527 | 3/1981 | Snyder et al. | 220/673 X |

*Primary Examiner*—Steven M. Pollard
*Attorney, Agent, or Firm*—Benjamin J. Barish

[57] ABSTRACT

A high pressure plastic container is made by rotationally moulding a first wall of plastic material, and a second wall enclosing and bonded to the first wall. One of the walls is integrally formed with a plurality of circumferentially-extending axially-spaced ribs of a hollow construction. The other wall may be unribbed, or may be integrally formed with a plurality of axially-extending circumferentially-spaced hollow ribs. The hollow ribs, are filled with a rigid plastic foam.

11 Claims, 6 Drawing Sheets

FIG 5
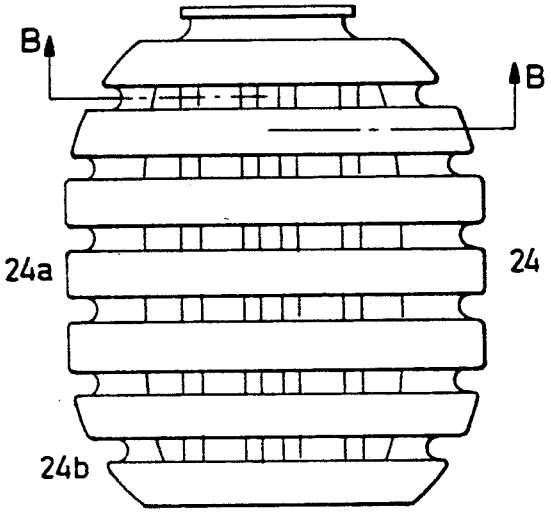
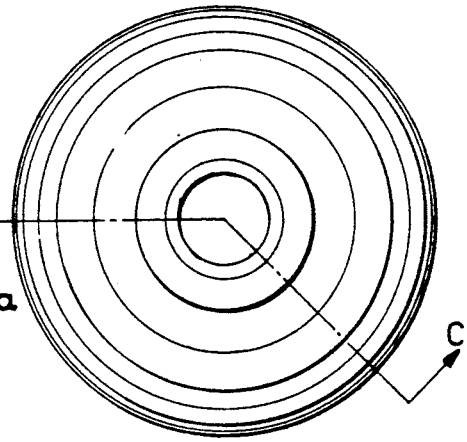
FIG 5a
FIG 5c
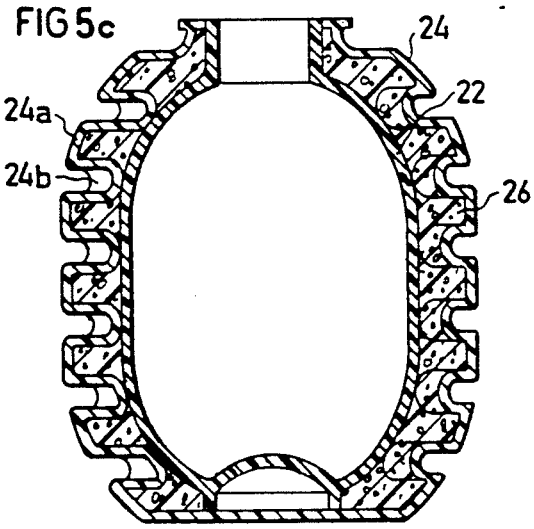
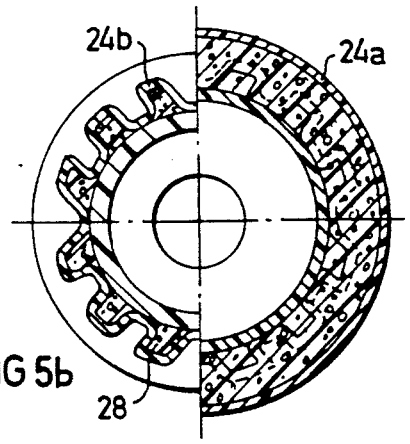
FIG 5b

MULTIPLE-WALL PLASTIC CONTAINER AND METHOD OF MAKING SAME

FIELD AND BACKGROUND OF THE INVENTION

The present invention relates to containers, and particularly to plastic containers capable of withstanding high internal or external pressures both in the axial direction as well as in the radial direction.

Containers (which expression also includes vessels, housings, tanks, etc.), particularly large constructions useful for containing liquids or gasses under high pressure, are at the present time usually built of metal and/or laminated composite materials because of the high resistance required in order to withstand high axial and radial pressures. Containers made of metal are very time-consuming and costly to build because of the need first to produce the various components of the container and then to assemble them together, e.g., by welding. Moreover, a high degree of expertise is required because if the welding (or other bonding technique) used for assembling the components together is not perfectly executed, leaks may develop during the use of the container. Further, metal containers tend to corrode, oxidize, pit or develop unpleasant odours or tastes, unless non-corrosive metals are used, such as stainless steel, or protective layers or coatings are applied, both of which substantially increase the expense and/or time in producing the containers. Building containers made from laminated composite materials is also time- C consuming, expensive and expertise-dependent because of the need to manufacture the components and then assemble them together.

OBJECTS AND BRIEF SUMMARY OF THE PRESENT INVENTION

An object of the present invention is to provide a plastic container particularly useful for containing liquids or gasses under high-pressure and having advantages in the above respects. Another object of the invention is to provide plastic containers having very high strength relative to their weight and cost; and a further object of the invention is to provide a method of making the novel plastic containers.

According to the present invention, there is provided a high pressure plastic container comprising a first wall of moulded plastic material closed at the bottom and open at the top; and a second wall of moulded plastic material closed at the bottom and open at the top, and bonded to the first wall. One or both of the walls are integrally formed with a plurality of ribs of a hollow construction.

According to a further feature in the preferred embodiments of the invention described below, the hollow ribs are filled with a rigid plastic foam, which binds the two walls together to form an integral multiple-wall construction of very high strength.

The multiple-wall plastic containers may be produced by rotational moulding. Rotational moulding is a low-pressure process in which the strength required from the mould is minimal. The rotational mould may therefore be constructed of thin metal or plastic, so that the tooling costs are only a small fraction (usually less than one-fifteenth) the cost of a conventional injection-mould. A further advantage in using rotational moulding is that this low-pressure process produces parts which are relatively stress free, as compared to high-pressure injection moulding processes. This advantage is particularly important since it enables the production of very large containers of various configurations, such as sperical, cylindrical, ellipsoidal, conical, and almost any other desired configuration, having substantially stress-free walls, very high strength relative to weight and cost and very high resistance to internal and external forces applied radially as well as axially.

Thus, the radial strength of a container is usually in the order of 50% its axial strength; but by providing the above-described hollow ribs, the radial strength can be increased to be substantially equal to the axial strength of the container. In addition, such a multiple-wall container can be produced in a fraction of the time normally required for producing comparable containers from metal or from laminated composite material. Further, such multiple-wall plastic containers can use different materials for the two walls to provide maximum strength as well as maximum resistance to corrosion, oxidation, pitting, or the development of unpleasant odours or tastes.

In producing such a multiple-wall plastic container, each wall is preferably made by a one-shot rotationally-moulding process, in which each wall is made as a continuous and integral shell. Thus, the inner wall is first produced by rotational moulding so as to be closed at its bottom and open at its top; and then the second wall is produced by rotational moulding directly around the inner wall. The plastic foam is them introduced into the space between the two walls to fill the hollow ribs and to integrally bond the two walls together, to thereby produce an integral honeycomb structure that is light and strong relative to its weight and cost.

Several embodiments of the invention are described below for purposes of example.

In one described embodiment, one of the plastic walls is integrally formed with circumferentially-extending axially-spaced hollow ribs, and the second wall is integrally formed with a plurality of axially-extending circumferentially-spaced ribs directly over the inner wall. Both the circumferentially-extending ribs of one wall and the axially-extending ribs of the other wall are of U-shaped cross-section such that the two groups of ribs cross each other substantially at right angles to produce a two-dimensional matrix or honeycomb structure which is subsequently filled with the rigid plastic foam.

A second embodiment is described below wherein one of the walls, e.g., the inner wall, is unribbed so as to provide a smooth inner surface.

A third embodiment of the invention is described below wherein one of the walls (e.g., the inner wall) is unribbed, and the other wall (e.g., the outer wall) is integrally formed with both circumferentially-extending, axially-spaced hollow ribs, and axially-extending, circumferentially- spaced hollow ribs.

A fourth embodiment of the invention is described wherein the container is made of three walls, namely an inner unribbed (smooth) wall, a middle wall formed with the above-described ribs, and an outer unribbed (smooth) wall.

Further embodiments, features and advantages of the invention will be apparent from the description below.

BRIEF DESCRIPTION OF THE DRAWINGS

The invention is herein described, by way of example only, with reference to the accompanying drawings, wherein:

FIGS. 5 and 5*a* are side and plan views, respectively, illustrating a third multiple-wall plastic container constructed in accordance with the invention; FIG. 5*b* is a sectional view along line b—b of FIG. 5; and FIG. 5*c* is a sectional view along line c—c of FIG. 5*a*.

DESCRIPTION OF PREFERRED EMBODIMENTS

Figure 1:
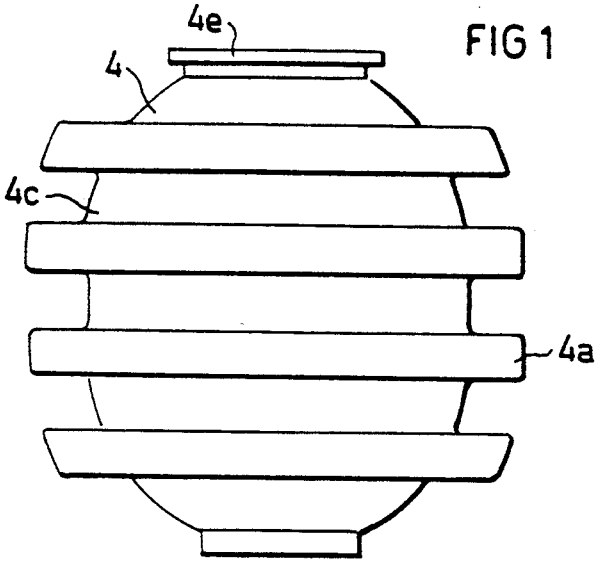
FIGS. 1 and 1*a* are side and plan views, respectively, illustrating one form of multiple-wall plastic container constructed in accordance with the present invention, FIG. 1*b* being a sectional view along line b—b of FIG. 1*a;*
Figure 2:
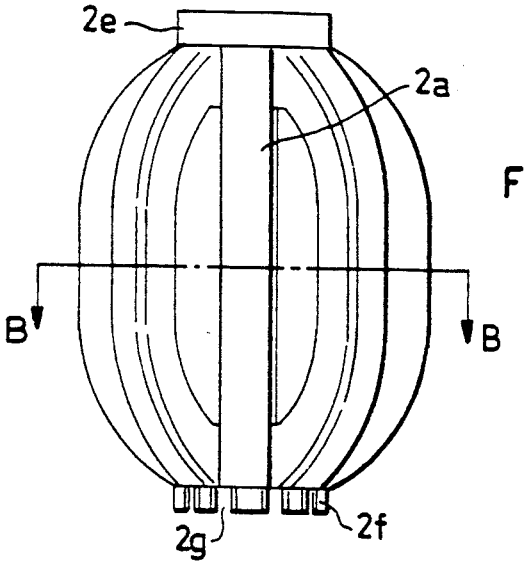
FIGS. 2 and 2*a* are side and plan views, respectively, illustrating the construction of the inner wall in the container of FIG. 1.
Figure 2A:
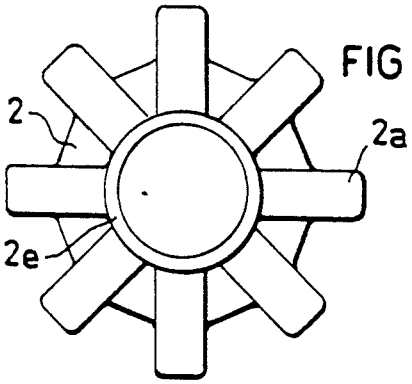
Figure 2B:
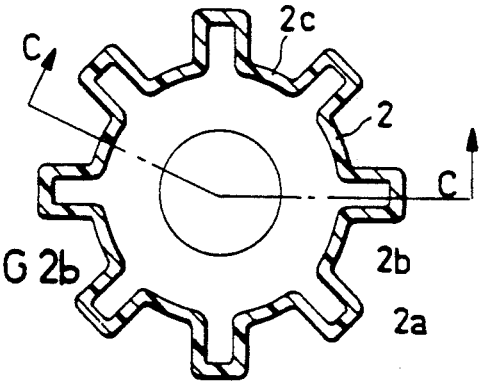
FIG. 2*b* is a sectional view along line b—b of FIG. 2.
Figure 2C:
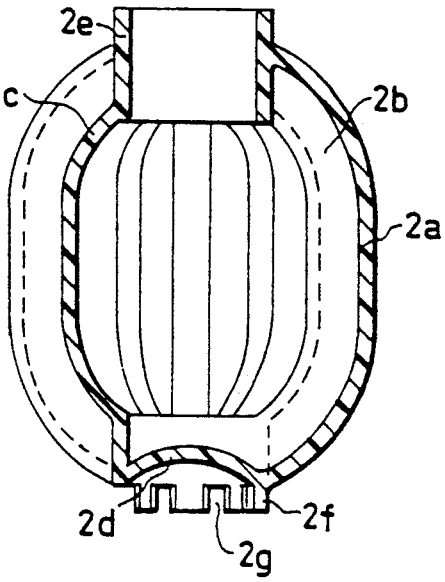
FIG. 2*c* is a sectional view along line c—c of FIG. 2*b*.
Figure 3:
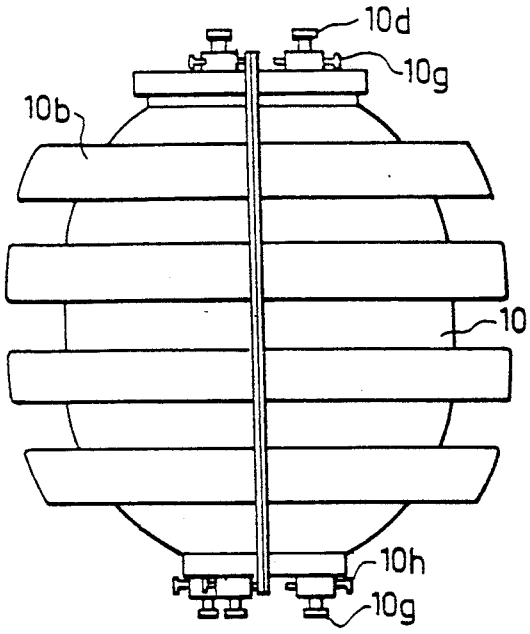
FIGS. 3 and 3*a* are side and plan views, respectively, illustrating the mould during its use in the production of the outer wall of the container of FIG. 1.

The Embodiment of FIGS. 1-3

Figure 3A:
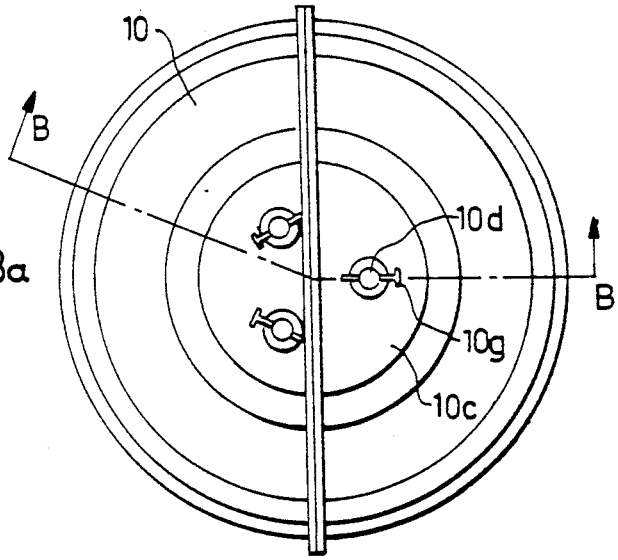
Figure 3B:
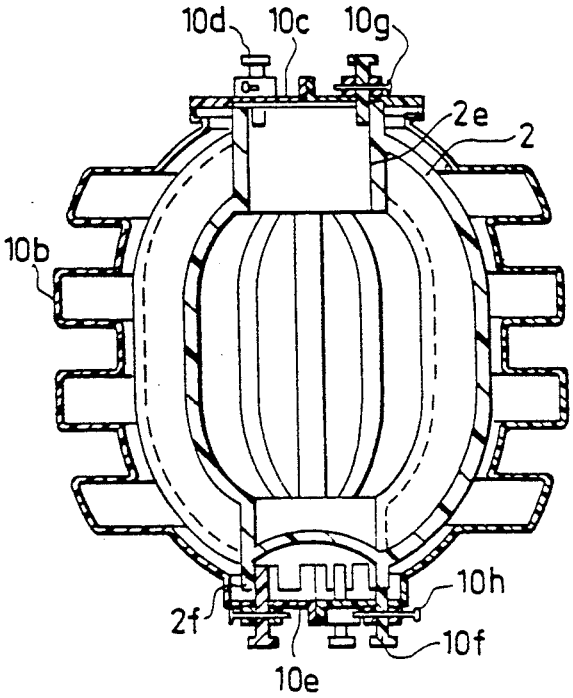
FIG. 3*b* being a sectional view along line b—b of FIG. 3*a;*

FIGS. 1-3 illustrate a plastic container constructed of an inner plastic wall, generally designated 2, and an outer plastic wall, generally designated 4, both made by a rotational- moulding process, in which the inner wall 2 is first produced, and then the outer wall 4 is produced directly over the inner wall 2. FIGS. 2 and 2*a*-2*c* more particularly illustrate the structure of the inner wall 2, and FIGS. 3, 3*a* and 3*b* illustrate the construction of the rotational-mould for producing the outer wall 4 over the inner wall 2.

The inner wall 2 is integrally formed with a plurality of axially-extending circumferentially-spaced hollow ribs 2*a*. As shown particularly in FIG. 2*b*, each rib 2*a* is of a U-shaped configuration to provide a space 2*b* between the two legs of the rib; and the ribs are joined together by web portions 2*c* of smaller diameter than the ribs 2*a* such that the ribs 2*a* radiate outwardly from the web portions 2*c* of wall 2. As shown particularly in FIG. 2*c*, wall 2 is closed at one end by a curved bottom wall 2*d*, and is open at its opposite end by a cylindrical wall 2*e*. The closed bottom wall 2*d* is circumscribed by an axially-extending flange 2*f* formed with a plurality of axially-extending slots 2*g*, for a purpose to be described below.

The outer wall 4 is formed with a plurality of circumferentially-extending axially-spaced ribs 4*a* which cross ribs 2*a* at right angles. Ribs 4*a* are also of U-shape cross-section to provide a space 4*b* between the two legs of each rib, and are also joined together by a web portion 4*c* which is of smaller diameter than the ribs 4*a* so that the ribs project outwardly from the web portion of wall 2. The spaces between the legs of the ribs 2*a* and 4*a* thus interconnect and form interconnecting conduits. These interconnecting spaces or conduits are filled with a rigid plastic foam 6 which binds the two walls and produces therewith a two-dimensional honeycomb structure substantially increasing the structural strength of the container with respect to both radial forces as well as axial forces.

The outer wall 4 is closed at one end by bottom wall 4*d* which is spaced from the curved bottom wall 2*d* of the inner wall 2. The opposite end of wall 4 is open and is formed with an annular lip 4*e* which engages the outer surface of the cylindrical opening 2*e* of inner wall 2. The bottom wall 4*d* is further provided with one or more openings 4*f* inwardly of axial flange 2*f* formed in the inner wall. Openings 4*f* serve as inlet ports for injection the rigid plastic foam into the spaces between the two walls 2, 4; and the slots 2*g* in the axial flange 2*f* of the inner wall permit the injected plastic foam to fill all the spaces between the two walls, including the space between the two bottom walls 2*d*, 4*d* and the spaces between the plurality of ribs 2*a*, 4*a*, of the two walls.

Each of the two walls 2, 4, is produced by a one-shot rotational-mould process. In each case, the rotational mould is a shell-type mould that defines the outside shape and surface of the respective wall. The inside surface of the respective wall is defined by the outside shape and the wall thickness.

Thus, since the inner wall 2 is formed with a plurality of axially-extending, circumferentially-spaced hollow ribs 2*a*, the cavity of the rotational mould used for producing the inner wall 2 would be formed with complementary axially-extending, circumferentially-spaced recesses; and since the outer wall 4 is formed with a plurality of axially-extending, circumferentially-spaced ribs 4*a*, the cavity of the mould for producing that wall would be formed with a plurality of complementary axially-extending, circumferentially-spaced recesses. The mould for producing the outer wall 4 is more particularly seen in FIGS. 3, 3*a* and 3*b*, wherein it is generally designated 10; and while the construction of the mould for producing the inner wall 2 is not shown in the drawings, its construction will be apparent from the description below of mould 10.

Figure 1A:
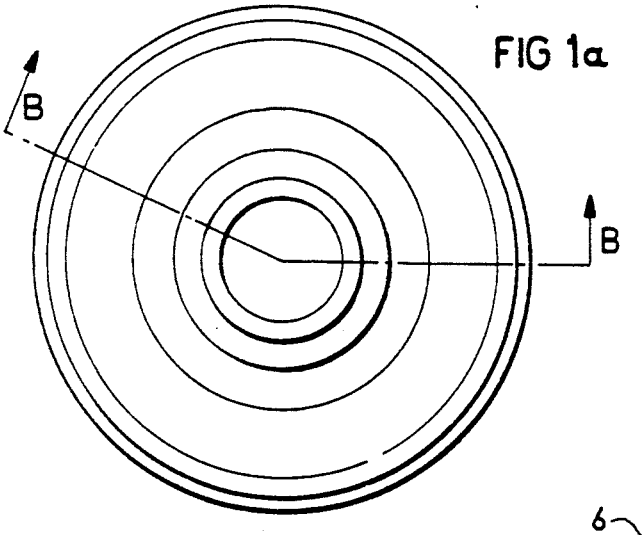
Figure 1B:
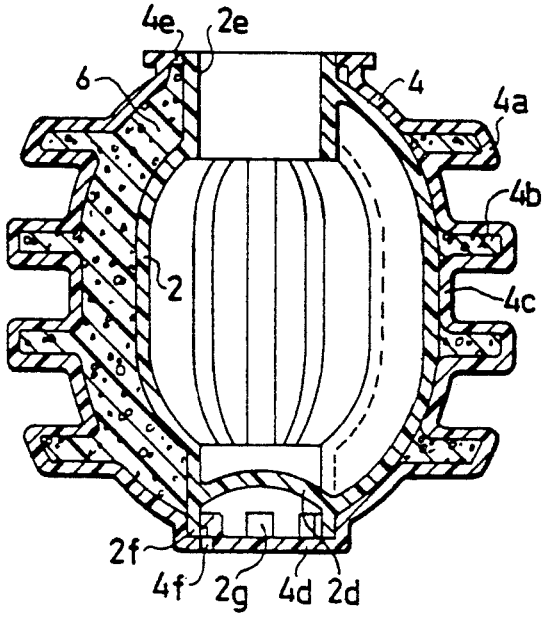

Thus, in order to produce the double-wall construction illustrated in FIGS. 1, 1*a* and 1*b*, the inner wall 2, as illustrated in FIGS. 2 and 2*a*-2*c*, is first produced by rotational moulding. For this purpose, a measured amount of plastic material to be used for producing wall 2 is placed, in powder or liquid form, in the cavity of a rotational mould, having a cavity corresponding to the outer surface of the wall 2 to be produced, as described above, and the mould is closed. The mould is then placed into an oven where it is continuously rotated about both its vertical and horizontal axes as the mould is heated. The biaxial rotation of the mould causes the plastic material within it to come into intimate contact with all the surfaces of the mould cavity. The biaxial rotation continues until all the plastic material has been melted so as to completely cover the mould cavity and to form a uniform layer of melted plastic.

While the biaxial rotation continues, the mould is moved out of the oven into a cooling chamber where air, or a mixture of air and water, cools the mould and the layer of moulten plastic material within it until the plastic layer sufficiently hardens so as to retain its shape.

The so-produced inner wall 2 is then removed from the mould and placed into the outer mould 10 for producing the outer wall 4. FIGS. 3, 3*a* and 3*b* more particularly illustrate the construction of the outer mould 10, wherein it will be seen that the inner surface of the mould, defining the cavity, is shaped so as to conform to the outer surface of the outer wall 4 to be integrally formed on the inner wall 2.

Thus, mould 10 is formed with a plurality of circumferentially-extending axially-spaced recesses 10*a* to produce the ribs 4*a* in wall 4, the spaces 4*b* between the two legs of each rib, and the web portions 4*c* connecting the ribs together. Mould 10 is dimensioned so that its inner face thus conforms to the outer face of wall 2, and is spaced from the previously-formed inner wall 2 by the intended thickness of the outer wall 4.

As shown particularly in FIG. 3*a*, mould 10 is made of two sections that come together along a longitudinally-extending parting line 10*b*. In addition, the upper end of the mould is provided with a top wall 10*c* closing the open end of the inner wall 2, and with three locating pins 10*d* engageable with the inner face of the cylindrical wall 2*e* at the open end of that wall. The bottom end of the mould is similarly provided with a bottom wall 10*e* and with a plurality of locating pins 10*f* engageable with the inner surface of the axial flange 2*f* of the inner wall 2. Preferably, the top and bottom walls 10*c*, 10*e*, and the locating pins 10*d*, 10*f*, are made of a material which is non-adherent to the plastic material being moulded. For example, the latter parts may be made of, or coated with, a flouroethylene polymer or a silicone.

The top mould wall 10*c* closes the open end of the inner wall 2 and prevents plastic material from entering the interior of that wall when the outer wall 4 is moulded around the inner wall 2. The bottom mould wall 10*e* is spaced from the outer edge of the axial flange 2*f* of the inner plastic wall 2, so as to define the space for producing the bottom of the outer plastic wall 4; and the bottom pins 10*f* define the openings 4*f* through the bottom plastic wall 4*d* for subsequently introducing the rigid plastic foam 6 binding the two plastic walls together. Locating pins 10*d* and 10*f* may be retained in their respective mould walls by retainer pins 10*g*, 10*h*.

The outer wall 4 is rotationally moulded within mould 10 in the same manner as described above with respect to the inner wall 2. After the outer wall 4 has been moulded integral with the inner wall 2, the two plastic walls are removed from the mould, and a plastic foam is injected, via openings 4*f* (FIG. 1*b*) through the bottom 4*d* of the outer plastic wall 4. The plastic foam fills the space between the two bottom walls 2*d*, 4*d*, and flows through the slots 2*g* so as also to fill the remaining spaces between the two walls, including the spaces between the hollow ribs 2*a* and 4*a*.

The two walls 2, 4, may be made of any suitable plastic material which can be caused to flow (e.g., by heating) and which hardens so as to retain its shape. Each wall can be produced from a different plastic material to maximize the desired characteristics of such materials, with respect to ease of moulding, mechanical strength, melting temperature, inertness to various chemicals, environmental resistance to weather and soil, etc.

The rigid plastic foam injected into the spaces between the two walls may also be of any suitable material, such as polyurethane. The rotational moulds for producing the inner wall 2 and the outer wall 4 may be of any suitable material, such as steel, aluminum, stainless steel sheet metal, electroformed nickel, etc. Where the moulding is to be effected at relatively low temperatures, e.g., room temperature, a thermosetting polymer, e.g., polyester, epoxy resin, silicone rubber, or impregnated fibreglass may be used for the moulds.

Figure 4:
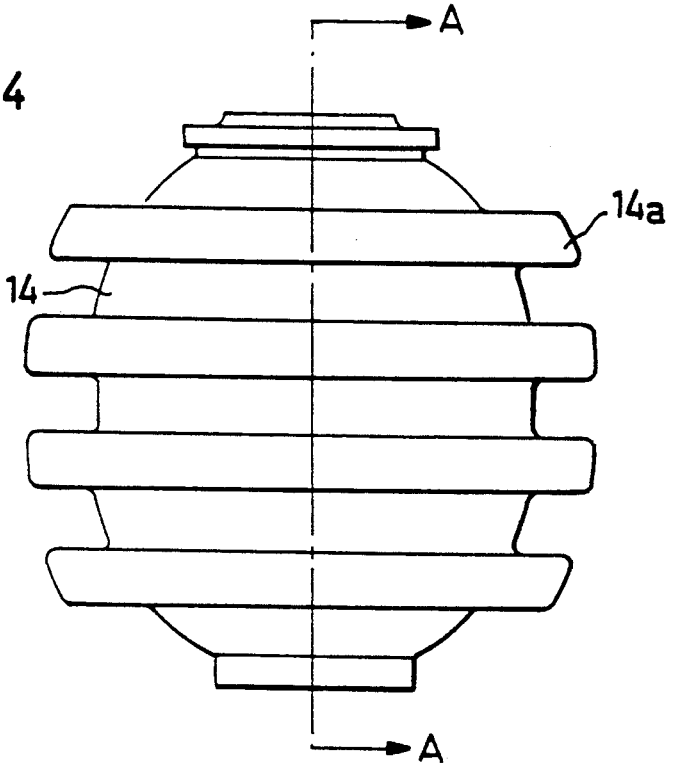
FIG. 4 is a side elevational view illustrating a second multiple-wall plastic container constructed in accordance with the invention, FIG. 4*a* being a sectional view along line a—a of FIG. 4.
Figure 4A:
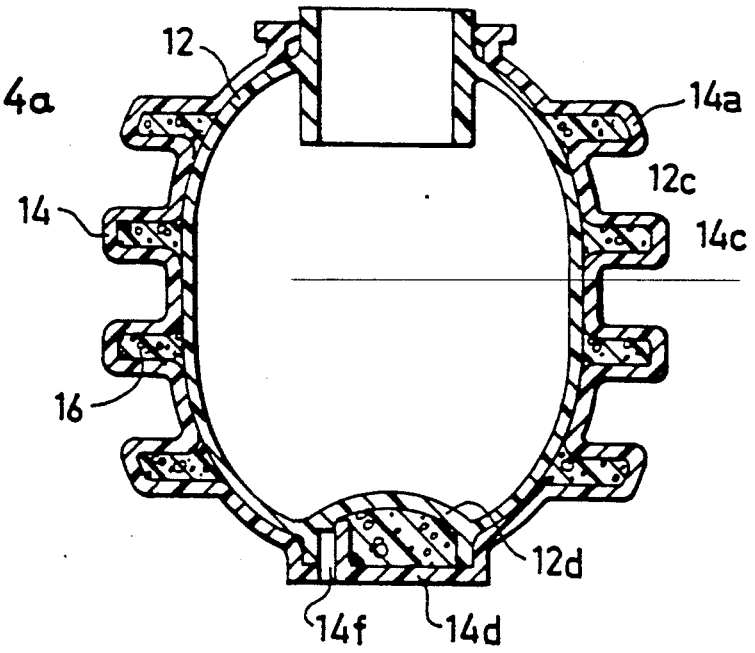

The Embodiments of FIGS. 4 and 4*a*

FIGS. 4 and 4*a* illustrate a double-wall plastic container in which the inner wall, therein designated 12, is unribbed; that is, both its inner and outer surfaces are smooth. In all other respects, the inner wall 12, and the outer wall 14, are of the same construction, and are made in the same manner, as described above with respect to the embodiment of FIGS. 1–3.

In the embodiment of FIGS. 4 and 4*a*, the space between the two walls 12, 14, is also preferably filled with a rigid plastic foam 16. This may be done by providing openings in the bottom of the outer wall 14*e*, as shown at 14*f* in FIG. 4*a*, for injecting the plastic foam, and also corresponding openings (not shown) in each of the ribs 14*a* of the outer wall 14; alternatively, communication may be provided in the spaces between all the ribs with the space between the bottom 14*d* and 12*d* of the outer wall 14 and inner wall 12 by forming one or more axially-extending grooves (not shown) in the outer face of the inner wall web portions 12*c*, or in the inner face of the outer wall web portions 14*c*.

The construction illustrated in FIGS. 4 and 4*a* is particularly useful where sufficient mechanical strength is obtained by only the circumferentially-extending grooves 14, and where the nature of the contents of the container is such that it is preferred that the container have an inner smooth surface.

The Embodiment of FIGS. 5 and 5*a*–5*c*

FIGS. 5 and 5*a*–5*c* illustrate a double-wall plastic container which is also constructed of an inner wall 22 and outer wall 24 integrally joined together by a rigid plastic foam 26. In this container, the inner wall 22 is also unribbed (as inner wall 12 in the FIGS. 4, 4*a* embodiment), but the outer wall 24 is formed with biaxial ribs, namely with a plurality of circumferentially-extending, axially-spaced ribs 24*a*, and also with a plurality of axially-extending, circumferentially-spaced ribs 24*b*. The bottoms of the two walls 22, 24 are formed in the same manner as described above. Also, openings, corresponding to openings 14*f* (FIG. 4*a*) or 4*f* (FIG. 1*b*), are formed for injecting the rigid plastic foam between the two walls in order to fill the spaces defined by the ribs and to bond the two walls together and thereby to produce an integrated wall structure having the ribs 24*a*, 24*b* extending along both axes. It will be appreciated that the axially-extending ribs 24*b* provide communication 28 between the circumferentially-extending ribs 24*a*, permitting the rigid plastic foam to be injected in a one-shot manner, as described above with respect to the embodiment of FIGS. 1–3.

In all other respects, the container illustrated in FIGS. 5 and 5*a*–5*c* is constructed in the same manner as described above.

Figure 6:
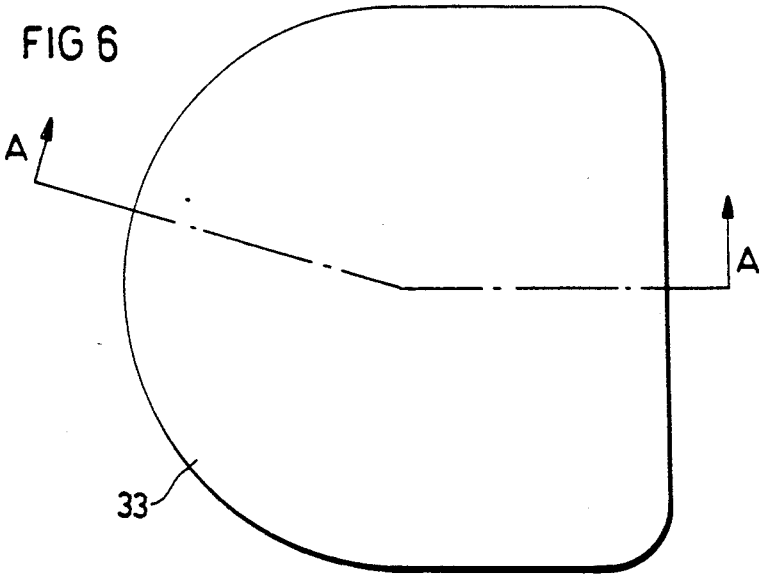
FIG. 6 is a plan view illustrating a fourth multiple-wall plastic container constructed in accordance with the invention, FIG. 6*a* being a sectional view along line a—a of FIG. 6.
Figure 6A:
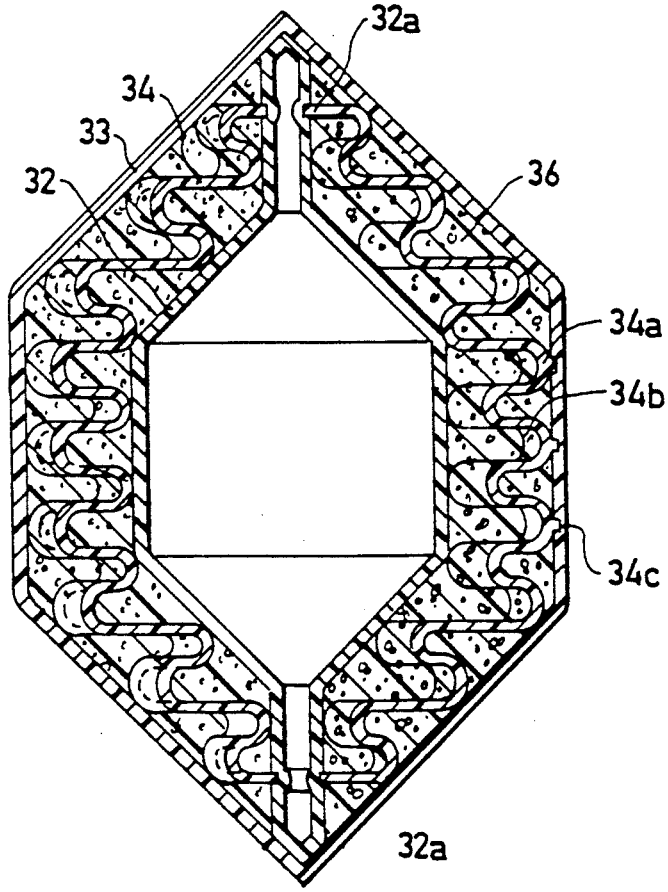

The Embodiments of FIGS. 6 and 6*a*

FIGS. 6 and 6*a* illustrate a multiple-wall plastic container including three walls, namely an inner wall 32, an outer wall 33, and an intermediate wall 34. Both the inner wall 32 and the outer wall 33 are unribbed, whereas the intermediate wall 34 is formed with the hollow ribs enhancing the mechanical strength of the container. In this case, the intermediate wall 34 is formed with the biaxial ribs similar to the FIG. 5 embodiment, that is with both circumferentially-extending, axially-spaced ribs 34*a*, and axially-extending, circumferentially-spaced ribs 34*b*. In addition, the spaces between these ribs are completely filled with the rigid plastic foam 3 thereby firmly bonding all three walls together to produce an integrated, honeycomb wall structure containing the biaxially-extending ribs.

In the biaxial-rib construction illustrated in FIG. 6*a*, the rigid plastic foam may be introduced via openings formed in the bottom wall, similar to the FIGS. 1–3 and FIG. 5 embodiments, since the axially-extending ribs provide communication between the circumferentially-extending ribs. If, however, the intermediate wall 34 is provided only with circumferentially-extending ribs, the plastic foam would be introduced in one of the manners described above with respect to the FIGS. 4, 4*a* embodiment. If wall 34 is provided only with axially-extending ribs, the plastic foam could also be introduced from the bottom in the same manner as described above.

When a three-wall construction is to be produced as illustrated in FIGS. 6 and 6*a*, each of the three walls would be produced in a separate rotational-moulding step. The inner wall 32 would be a single continuous wall, as illustrated in FIG. 6*a*, and could take the quasi-hexagonal configuration as illustrated in FIG. 6*a*, or any other suitable configuration. The intermediate wall 34 is preferably constructed of two sections on opposite sides of the inner wall 32, with the end of each section received in a recess as shown at 32*a* in FIG. 6*a*, formed in the inner wall 32. The two sections of the intermediate wall 34 could be further formed with projections as shown at 34*c*, received within recesses formed in the outer wall 33 in order to firmly anchor the intermediate wall sections 34 between the two walls 32, 33, particularly when the rigid plastic foam is injected between the two walls.

Other Variations

While the invention has been described with respect to several preferred embodiments, it will be appreciated that many other variations may be made. For example, in the FIGS. 1–3 embodiment, the circumferentially-extending ribs may be formed on the inner wall (e.g., when the container is used for a pressurized gas), and the axially-extending ribs may be formed in the outer wall. In the FIG. 4 embodiment, the outer wall 14 may be formed with axially-extending, circumferentially-spaced ribs, rather than with circumferentially-extending, axially-spaced ribs; also, the ribs may be formed in the inner wall, rather than in the outer wall, particularly when the container is to be used for a pressurized gas. Similarly, in the FIG. 5 embodiment, the biaxally-extending ribs may be formed in the inner wall, rather than in the outer wall. Further, in the FIG. 6 embodiment, as well as in the other described embodiments, the anchoring of one wall to the other or others may be effected by producing a shrink-fit of one wall on the other, by heat fusion, or the like. It will also be appreciated that containers of other configurations may be produced according to the invention.

Many other variations, modifications and applications of the invention will be apparent.

What is claimed is:

1. A high pressure plastic container, comprising: wall means including a first wall of moulded plastic material closed at the bottom and open at the top;

and a second wall of moulded plastic material closed at the bottom and open at the top, and bonded to said first wall;

said wall means being formed with a first plurality of circumferentially-extending axially-spaced hollow ribs and with a second plurality of axially-extending circumferentially-spaced hollow ribs disposed substantially perpendicularly to said first plurality of hollow ribs.

2. The container according to claim 1, wherein one of said walls is formed with said circumferentially-extending, axially-spaced hollow ribs, and the of other said walls is formed with said axially-extending, circumferentially-spaced hollow ribs.

3. The plastic container according to claim 1, wherein said first wall is integrally formed with said plurality of circumferentially-extending axially-spaced hollow ribs, and also with said plurality of axially-extending, circumferentially-spaced hollow ribs.

4. The container according to claim 3, wherein the other of said walls is unribbed.

5. The container according to claim 4, wherein the unribbed wall is the inner wall of the container, and the ribbed wall is the outer wall of the container.

6. The container according to claim 3, wherein said wall means includes a third wall of plastic material enclosing and bonded to said second wall.

7. The container according to claim 6, wherein said second wall is between said first and third walls and is formed with all said hollow ribs, the spaces between said three walls all being filled with a plastic foam.

8. The container according to claim 1, wherein the innermost wall is formed with an inwardly curved closed bottom.

9. The plastic container according to claim 1, wherein said first and second walls are made of different plastic materials.

10. The plastic container according to claim 1, wherein each of said hollow ribs is of substantially U-shape in cross-section.

11. The container according to claim 1, wherein said hollow ribs are filled with a rigid plastic foam.

* * * * *